US008453333B2

(12) United States Patent
Long et al.

(10) Patent No.: US 8,453,333 B2
(45) Date of Patent: Jun. 4, 2013

(54) ELECTRIC HAND-HELD HAIR CUTTING APPLIANCE WITH BLADE CLAMPING DEVICE

(75) Inventors: Quan Long, Guang Zhou (CN); Wing Hong Chan, Ma On Shan (HK)

(73) Assignee: Rovcal, Inc., Madison, WI (US)

( * ) Notice: Subject to any disclaimer, the term of this patent is extended or adjusted under 35 U.S.C. 154(b) by 384 days.

(21) Appl. No.: 12/790,107

(22) Filed: May 28, 2010

(65) Prior Publication Data

US 2011/0289777 A1 Dec. 1, 2011

(51) Int. Cl.
*B26B 19/06* (2006.01)

(52) U.S. Cl.
USPC ..... 30/210; 30/216; 30/223

(58) Field of Classification Search
USPC ..... 30/43.92, 196, 201, 210, 216, 223
See application file for complete search history.

(56) References Cited

U.S. PATENT DOCUMENTS

| | | | | |
|---|---|---|---|---|
| 2,928,171 | A * | 3/1960 | Oster | 30/221 |
| 3,747,212 | A | 7/1973 | Krayl | |
| 3,962,785 | A * | 6/1976 | Poel | 30/34.1 |
| 4,458,417 | A | 7/1984 | Andis | |
| 4,765,060 | A * | 8/1988 | Veselaski et al. | 30/208 |
| 4,989,324 | A | 2/1991 | Andis | |
| 5,230,153 | A * | 7/1993 | Andis | 30/216 |
| 7,080,458 | B2 * | 7/2006 | Andis | 30/223 |
| 7,703,210 | B2 | 4/2010 | Lau | |
| 7,913,399 | B2 | 3/2011 | Lau | |
| 8,051,571 | B2 * | 11/2011 | Andis et al. | 30/210 |
| 2008/0052914 | A1 * | 3/2008 | Bednar | 30/216 |
| 2008/0168661 | A1 * | 7/2008 | Lau | 30/216 |
| 2008/0282550 | A1 | 11/2008 | Piwaron | |
| 2010/0229396 | A1 | 9/2010 | Bednar | |

OTHER PUBLICATIONS

Extended European Search Report EP 11250559.9 dated Sep. 13, 2011, 5 pages.

* cited by examiner

*Primary Examiner* — Hwei C Payer
(74) *Attorney, Agent, or Firm* — Armstrong Teasdale LLP

(57) ABSTRACT

A blade head assembly for a hand-held hair cutting appliance includes a blade clamping device urging a cutting edge margin of a second blade in sliding engagement with a cutting edge margin of a first blade. The blade clamping device includes a clamping head operable for pivoting generally toward and generally away from the second blade about a pivot axis. The clamping head is resiliently biased generally toward the second cutting blade about the pivot axis into sliding engagement with the second blade. The second blade is slidable relative to the clamping head during reciprocating movement of the second blade relative to the first blade.

19 Claims, 7 Drawing Sheets

ELECTRIC HAND-HELD HAIR CUTTING APPLIANCE WITH BLADE CLAMPING DEVICE

FIELD OF THE INVENTION

The field of the invention relates generally to electric hand-held hair cutting appliances, such as those used for hair trimming, clipping and shaving, and particularly to a blade clamping device for such electric hand-held hair cutting appliances.

BACKGROUND

Electric hand-held hair cutting appliances come in a number of different types depending on the intended use of the appliance, such as for trimming facial or body hair, clipping the hair on one's head or on a pet, or for shaving facial or body hair. Such hair cutting appliances typically have at least one stationary blade and at least one reciprocating blade. Each of the blades includes a plurality of shearing teeth defining a cutting edge margin. The shearing teeth of the reciprocating blade overlie, in face-to-face contact with, the shearing teeth of the stationary blade. The reciprocating blade is operatively connected to an eccentric drive assembly such that rotation of the drive assembly linearly reciprocates the reciprocating blade relative to the stationary blade so that the shearing teeth of the reciprocating blade reciprocate across the shearing teeth of the stationary blade, thereby producing shearing action between the reciprocating blade teeth and the stationary blade teeth.

It is common for the reciprocating blade to be held in sliding engagement with the stationary blade by a blade mounting device that typically includes a spring member that biases the blades together. Known conventional blade mounting devices, however, have several disadvantages. For example, one known blade mounting device includes a double torsion spring for such a purpose. The spring has a pair of arms that hold the reciprocating blade against the stationary blade. The coil portions of the spring are fixed relative to the stationary blade, so during reciprocating movement of the reciprocating blade, the spring arms cause the reciprocating blade to move along an arcuate path, rather than a desired linear path, relative to the stationary blade.

In another known example, the blade mounting device includes a double torsion spring pressing a linear guide component against the reciprocating blade for guiding the reciprocating blade along a linear path across the stationary blade. The linear guide component is connected to a base of the blade mounting device by a pair of resiliently flexible (i.e., elastic) arms. The arms are constructed to have a low modulus of elasticity so that a large majority of the force exerted by the spring is applied to the linear guide component, as opposed to the arms. However, because the arms have such a low modulus of elasticity, the arms tend to buckle during heavy loading, leading to the reciprocating blade moving rearward on the stationary blade. This rearward movement displaces the shearing teeth of the reciprocating blade relative to the shearing teeth of the stationary blade, which can negatively affect the quality of the cut by the hair cutting appliance.

SUMMARY

In one aspect, a hand-held hair cutting appliance generally comprises a first blade including a plurality of shearing teeth defining a first cutting edge margin, and a second blade including a plurality of shearing teeth defining a second cutting edge margin. The second cutting edge margin is in sliding engagement with the first cutting edge margin. A drive assembly of the appliance is operatively connected to the second cutting blade. The drive assembly is operable to impart reciprocating movement of the second blade relative to the first blade so that the shearing teeth of the second blade slide across the shearing teeth of the first blade. A blade clamping device of the appliance urges the second cutting edge margin in sliding engagement with the first cutting edge margin. The blade clamping device includes a clamping head configured for pivoting movement generally toward and generally away from the second blade about a pivot axis. The clamping head is resiliently biased generally toward the second blade about said pivot axis into sliding engagement with the second blade, whereby the second blade is slidable relative to the clamping head during said reciprocating movement of the second blade relative to the first blade.

In another aspect, a hand-held hair cutting appliance generally comprises a first blade having a cutting edge margin, and a second blade having a cutting edge margin overlying at least a portion of the cutting edge margin of the first blade. A drive assembly of the appliance is operatively connected to the second blade. The drive assembly is configured to impart reciprocating movement of the second blade relative to the first blade. A blade clamping device of the appliance holds the second blade in relation to the first blade. The blade clamping device includes a base, and a linear guide component engaging the second blade for guiding the second blade along a selected path during said reciprocating movement so that the cutting edge margin of the second blade moves in a substantially linear cutting path along the cutting edge margin of the first blade. At least one arm of the blade clamping device pivotally connects the linear guide component to the base to allow for movement of the linear guide component generally toward and generally away from the second cutting blade about a pivot axis. A spring member of the blade clamping device applies a load on the linear guide component in a direction generally toward the second cutting blade. The at least one arm has a bending stiffness sufficient to substantially resist bending of said at least one arm due to said load being applied to the linear guide component by the spring member.

In yet another aspect, a blade head assembly for a hand-held hair cutting appliance of the type including an electric drive assembly generally comprises a first blade including a plurality of shearing teeth defining a cutting edge margin, and a second blade including a plurality of shearing teeth defining a cutting edge margin. The cutting edge margin of the second blade is in sliding engagement with the cutting edge margin of the first blade and is configured for operative connection to the electric drive assembly of the hand-held hair cutting appliance to impart reciprocating movement of the second blade relative to the first blade. A blade clamping device of the blade head assembly urges the cutting edge margin of the second blade in said sliding engagement with the cutting edge margin of the first blade. The blade clamping device includes a clamping head operable for pivoting generally toward and generally away from the second blade about a pivot axis. The clamping head is resiliently biased generally toward the second cutting blade about said pivot axis into sliding engagement with the second blade, whereby the second blade is slidable relative to the clamping head during said reciprocating movement of the second blade relative to the first blade.

BRIEF DESCRIPTION OF THE DRAWINGS

Corresponding reference characters indicate corresponding parts throughout the drawings.

DETAILED DESCRIPTION OF THE DRAWINGS

Figure 1:
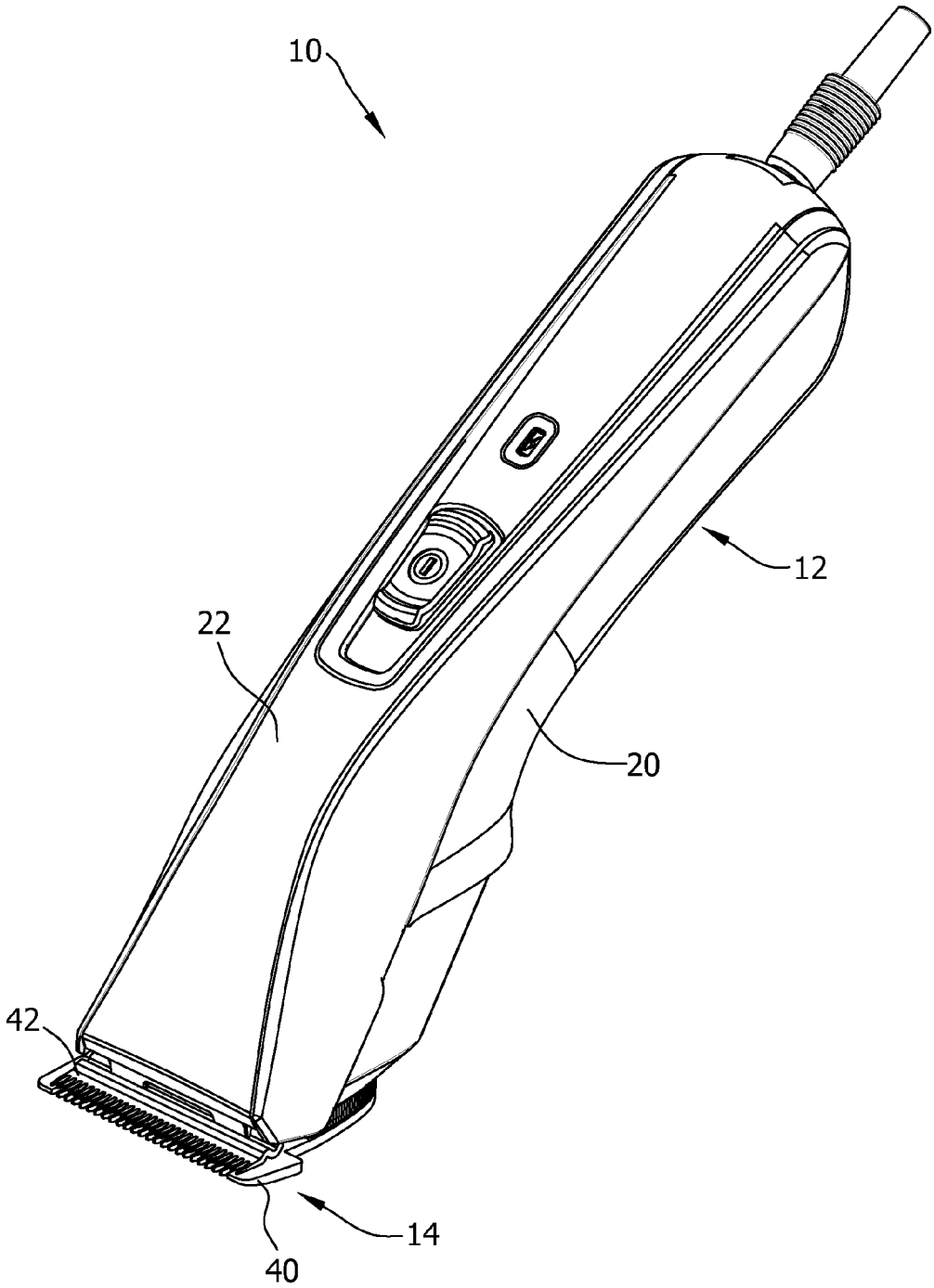
FIG. 1 is a perspective of one embodiment of a hand-held hair cutting appliance.
Figure 2:
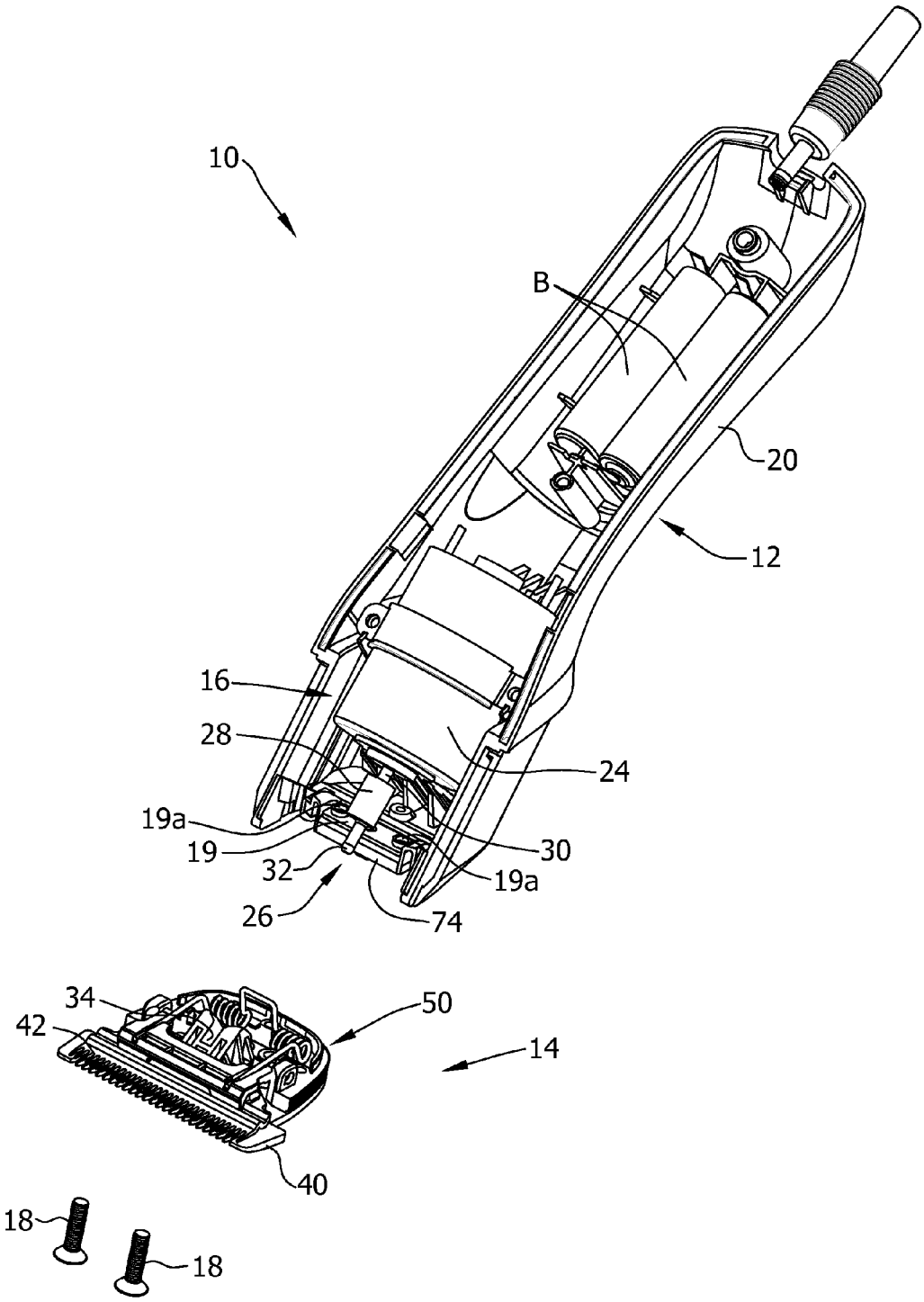
FIG. 2 is similar to FIG. 1 with a cover of a housing of the hair cutting appliance removed and a blade head assembly exploded from the housing.

Referring now to the drawings and in particular to FIGS. 1 and 2, one embodiment of an electric hand-held hair cutting appliance is generally indicated at 10. The illustrated appliance 10 is particularly configured for use as a hair trimmer to trim facial or body hair, although the appliance may be particularly configured for use as a hair clipper for clipping the hair on one's head or on a pet, or a shaver for shaving facial or body hair. The hair cutting appliance 10 broadly comprises a housing, indicated generally at 12, a blade head assembly, indicated generally at 14, configured for cutting hair, and a drive assembly, indicated generally at 16 (FIG. 2), at least in part within the housing for operating the blade head assembly. As explained in more detail below, the blade head assembly 14 is removably secured at one end of the housing 12 by a pair of screws 18 that extend through the blade head assembly and thread into a mounting plate 19 in the housing (FIG. 2). The blade head assembly 14 may be removably secured to the housing 12 in other ways, and it is contemplated that the blade head assembly 14 may be configured as a replaceable cartridge that is quickly and easily detachable from the housing.

The housing 12, or a portion thereof, is suitably sized and shaped as a handle so that it is easily held in a user's hand. The illustrated housing 12 is elongate and is of two-piece construction including a base 20 and a cover 22 (see FIG. 1, the housing cover being removed in FIG. 2) affixed to the base to define an interior space of the housing. The illustrated housing base 20 and housing cover 22 may be constructed of a light-weight, rigid plastic, but it is contemplated that the base and/or cover could alternatively be made from other suitable materials. The housing 12 may be of another suitable construction and may be suitably shaped other than as illustrated.

Figure 3:
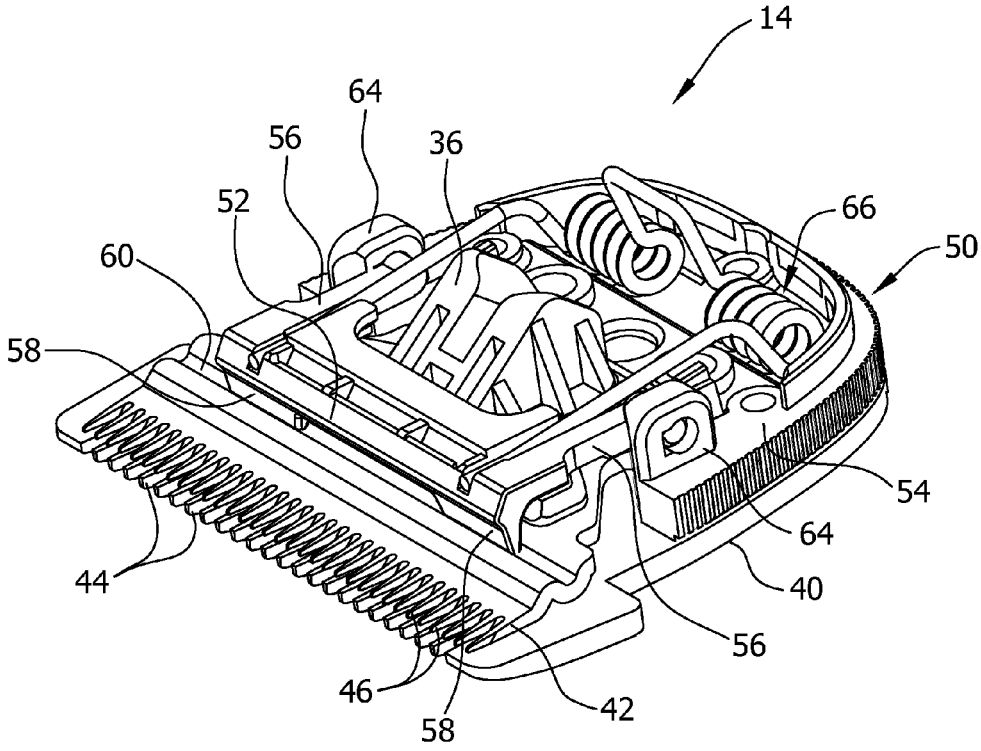
FIG. 3 is an enlarged perspective of the blade head assembly.

Referring to FIGS. 2 and 3, the illustrated drive assembly 16 generally comprises an electric drive motor 24 and an eccentric drive, generally indicated at 26, rotatably driven by the motor. The drive motor 24 may be powered by one or more batteries B within the housing and/or by another suitable internal or external electrical power source. In the illustrated embodiment, the eccentric drive 26 comprises a drive cylinder 28 operatively connected to an output shaft 30 of the motor 24, and an eccentric pin 32 that extends longitudinally outward from the drive cylinder at a location offset from the rotational axis of the output shaft. As explained in more detail below, the eccentric pin 32 is received in a slot 34 of a coupling 36 associated with the blade head assembly 14 for driving the blade head assembly. It is understood that the hair cutting appliance 10 may include an alternative suitable drive assembly for driving the blade head assembly 14 without departing from the scope of this invention.

Figure 4:
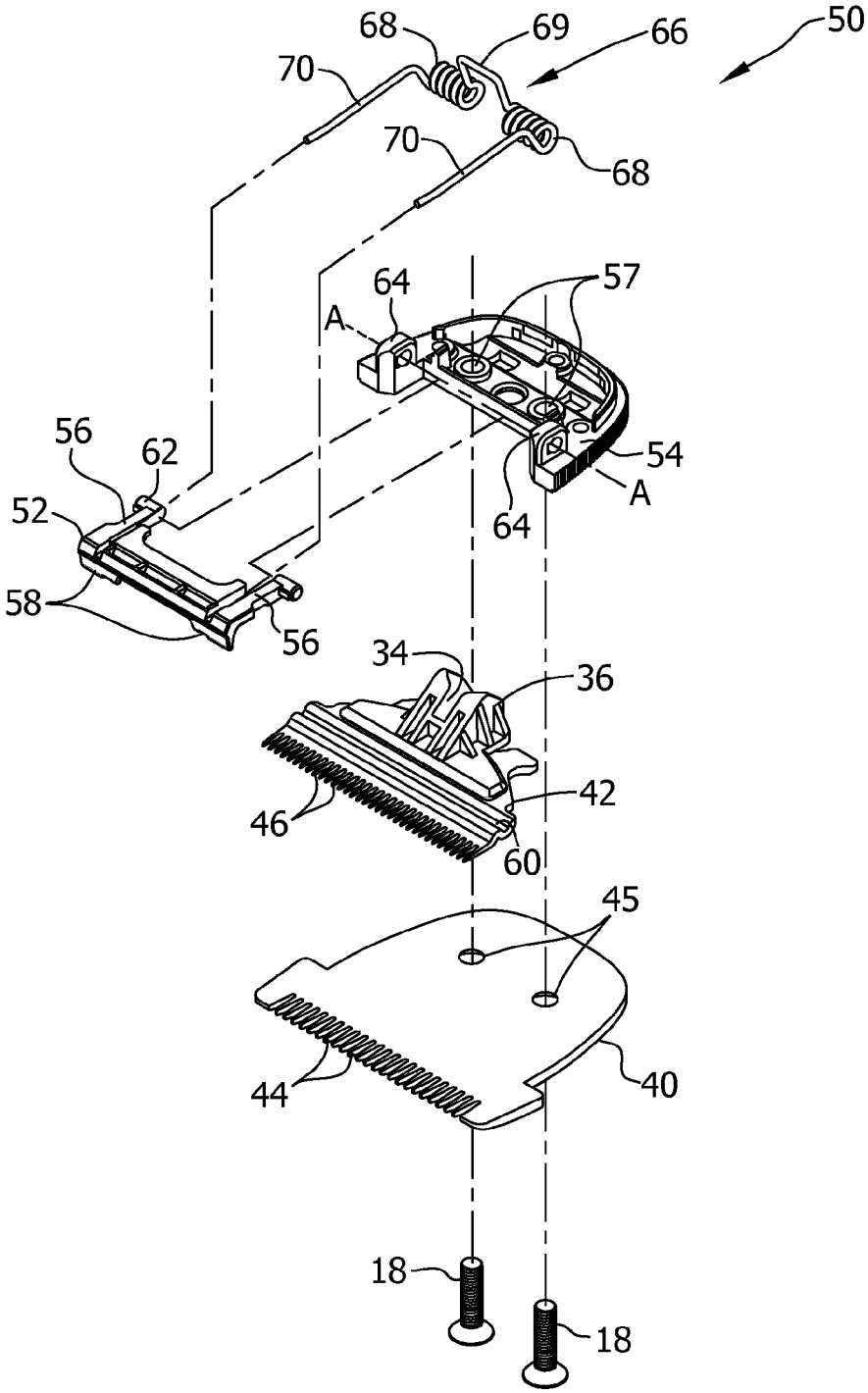
FIG. 4 is an exploded view of the blade head assembly.
Figure 5:
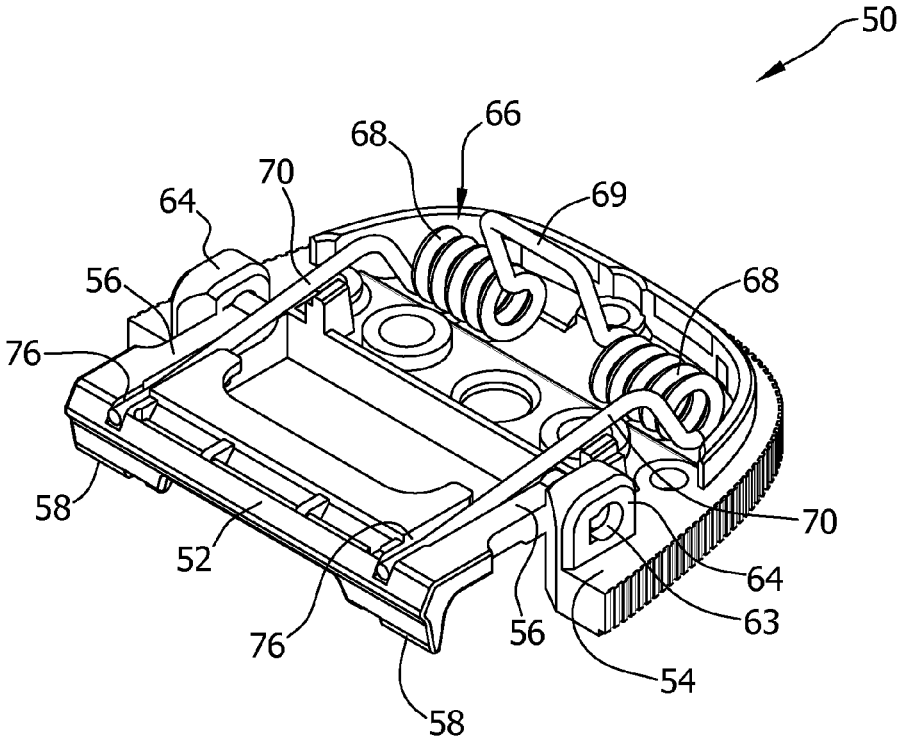
FIG. 5 is an enlarged perspective of a blade clamping device of the blade head assembly.

Referring to FIGS. 2-4, the blade head assembly 14 generally comprises a blade 40 (broadly, a first blade) and a reciprocating blade 42 (broadly, a second blade). In the illustrated embodiment, the blade 40 is a stationary blade in that it remains stationary relative to the housing 12 during cutting operation of the appliance 10. It is understood, however, that the blade 40, along with the reciprocating blade 42, may reciprocate relative to the housing 12 without departing from the scope of the present invention. The stationary blade 40 includes a plurality of shearing teeth 44 adjacent a side of the stationary blade and defining a cutting edge margin of the blade. The screws 18 pass through openings 45 in the stationary blade 40 to secure the stationary blade to the housing 12. The reciprocating blade 42 includes a plurality of shearing teeth 46 adjacent a side of the reciprocating blade and defining a cutting edge margin of the blade. The coupling 36 of the drive assembly 16 is secured to the reciprocating blade 42 for imparting reciprocating movement to the reciprocating blade. As explained in more detail below, the cutting edge margin of the reciprocating blade 42 is in face-to-face, sliding engagement with the cutting edge margin of the stationary blade 40 such that the shearing teeth 46 of the reciprocating blade move across the shearing teeth 44 of the stationary blade in a substantially linear cutting path (i.e., a straight cutting path). It is understood that in other embodiments the shearing teeth 46 of the reciprocating blade 42 may move across the shearing teeth of the stationary blade 40 in a suitable cutting path that is not linear without departing from the scope of the present invention. Both the stationary blade 40 and the reciprocating blade 42 may be constructed from metal, such as stainless steel, although it is understood that one or each of the blades 40, 42 may be constructed from other types of material, such as ceramic.

Referring to FIGS. 3-7, the blade assembly 14 also comprises a blade clamping device, generally indicated at 50, for holding the cutting edge margin of the reciprocating blade 42 in face-to-face, sliding engagement with the cutting edge margin of the stationary blade 40. The blade clamping device 50 generally comprises a clamping head 52 pivotally attached to a base 54 by a pair of arms 56. The fasteners 18 pass through openings 57 in the base 54 (FIG. 4), which are aligned with the openings 45 in the stationary blade 40, to secure the base to the stationary blade and the housing 12. The base 54 may be secured to the stationary blade 40 and/or the housing 12 in other suitable ways. Moreover, the base 54 may be formed integrally with the stationary blade 40 or the housing 12 without departing from the scope of the present invention.

As seen best in FIGS. 3 and 4, the clamping head 52 includes a pair of longitudinally aligned guide rails 58 that slidably engage the reciprocating blade through their reception in a groove 60 extending across the reciprocating blade 42. The pair of guide rails 58 constitutes a linear guide component that guides the reciprocating blade along a substantially linear cutting path during reciprocating movement of the reciprocating blade 42. In effect, the clamping head 52 remains stationary relative to the stationary blade 40 and the housing 12, and the reciprocating blade 42 moves or slides along the guide rails 58 of the clamping head. The guide rails 58 and the clamping head 52 together may suitably be integrally formed as a single piece, such as by plastic injection molding or in other suitable ways. Other suitable ways of forming the clamping head 52 and the guide rails 58 do not depart from the scope of the present invention.

It is understood that the linear guide component may comprise any number of suitable rails 58 other than two. It is also understood that the linear guide component may have another suitable configuration other than rail(s) 58, and/or the reciprocating blade 42 may have another suitable configuration other than the groove 60. For example, the linear guide component may comprise one or more grooves (not shown) that receive one or more rails (not shown) associated with the reciprocating blade 42. Moreover, the groove 60 or other structure may be part of a separate component that is secured to the reciprocating blade 42. Other suitable configurations are within the scope of the present invention. It is also contemplated that a guide component which guides the reciprocating blade 42 along a path other than substantially linear (i.e., straight) may be used in lieu of the linear guiding component. It is further contemplated that the linear guide component or other guiding component may be omitted from the clamping head 52, such that the clamping head does not guide the reciprocating blade 42 along a path.

Figure 6:
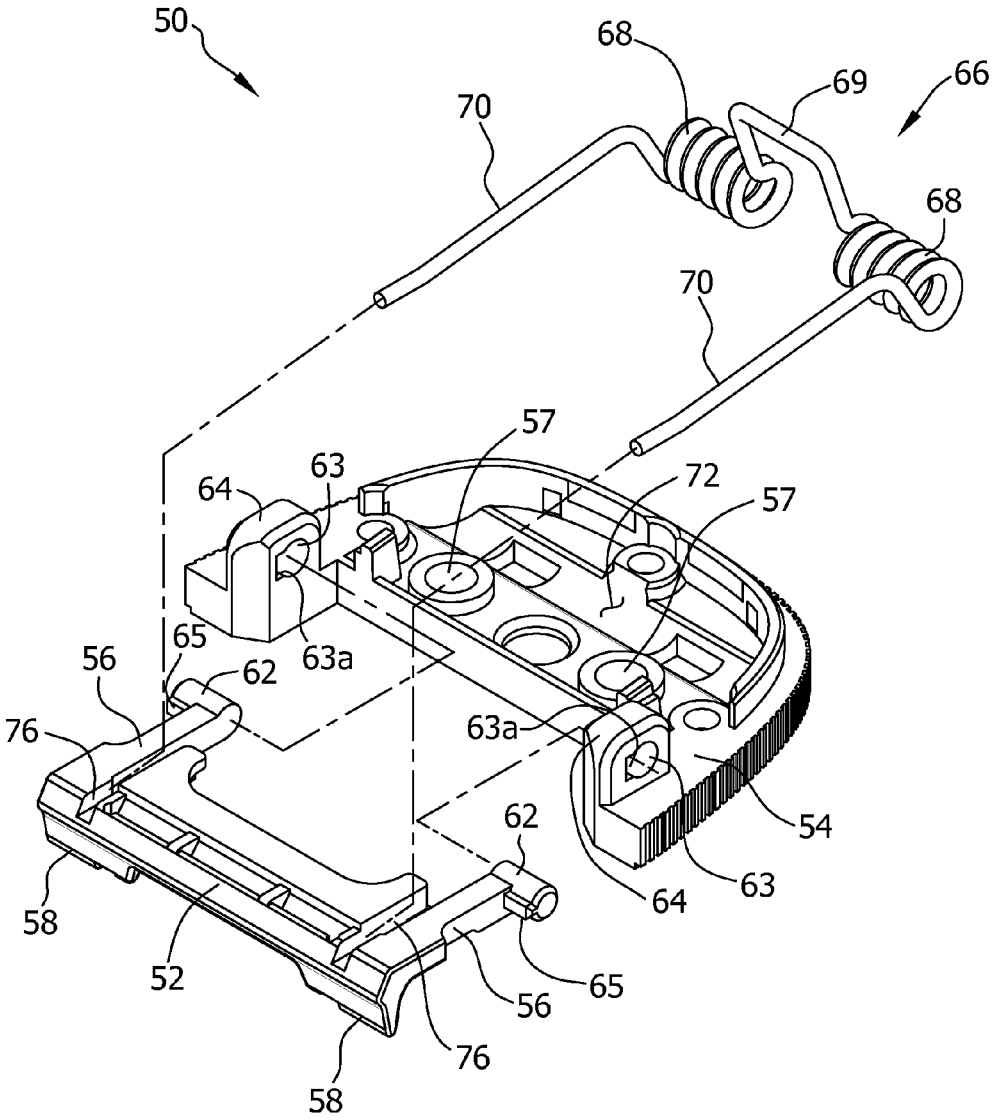
FIG. 6 is an exploded view of the blade clamping device.
Figure 7:
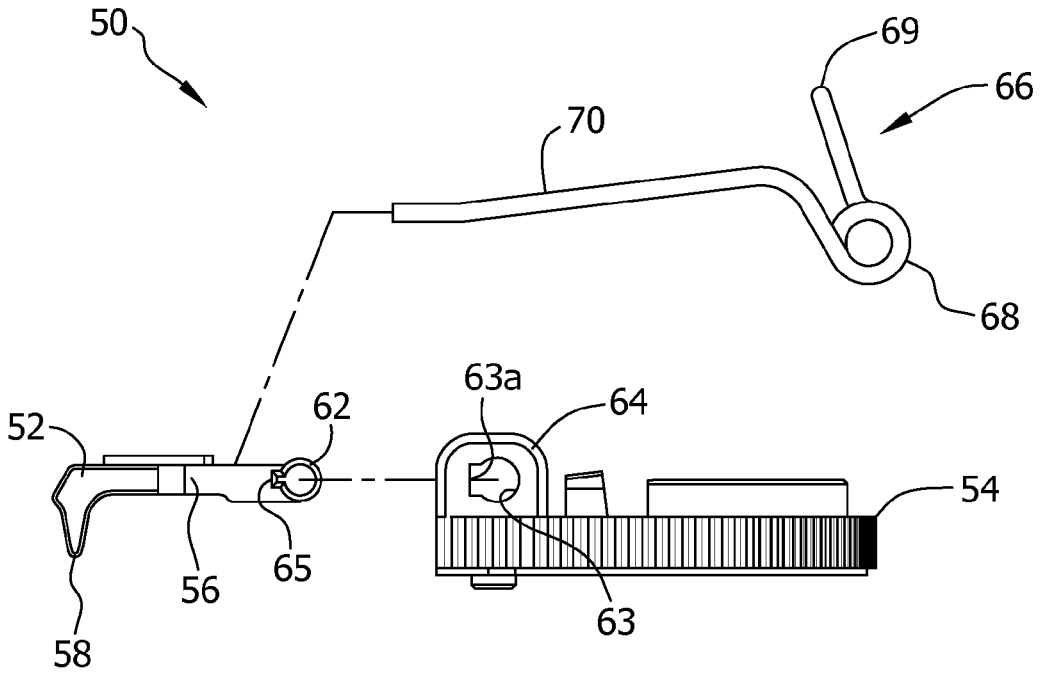
FIG. 7 is a side elevational view of FIG. 6.

As seen best in FIGS. 6 and 7, each of the arms 56 includes a pivot pin 62 extending laterally outward from an end margin of the arm. Each pivot pin 62 is insertable into a corresponding opening 63 of a bearing 64 on the base 54 such that the pivot pins are pivotably coupled with the respective bearings. As such, the clamping head 52 is pivotable generally toward and generally away from the reciprocating blade 42 about a pivot axis A defined by the rotation of the pivot pins 62 in the respective bearings 64. (It is understood that the pivot pins 62 or a single pivot pin may be formed separately from the arms 56.) As explained in more detail below, the arms 56 are relatively stiff to inhibit buckling of the arms when the hair cutting appliance 10 is under a relatively large load (i.e., when cutting thick hair or cutting hair relatively quickly). Such unwanted buckling may lead to movement of the clamping head 52 toward the base 54, which would move the cutting edge margin of the reciprocating blade 42 away from the cutting edge margin of the stationary blade 40 and negatively affect the quality of the cut. It is understood that the blade clamping device 50 may include any suitable number of arms 56, including a single arm. The arms 56 and the pivot pins 62 together may suitably be integrally formed as a single piece, such as by plastic injection molding or in other suitable ways. Moreover, the arms 56 and the pivot pins 62 together with the clamping head 52 and the guide rails 58 may suitably be integrally formed as a single piece, such as by plastic injection molding or in other suitable ways. Other suitable ways of forming the arms 56 and the pivot pins 62 do not depart from the scope of the present invention.

In the illustrated embodiment, as seen best in FIGS. 6 and 7, each pivot pin 62 includes a radially projecting rib 65 extending along the pivot pin, and each bearing opening 63 includes a keyed portion 63*a* for receiving the rib of the corresponding pivot pin. The keyed portions 63*a* of the openings 63 are sized and shaped to trap the respective ribs 65 in the keyed portions. In effect, the ribs 65 and the keyed portions 63*a* limit the degree of rotation of the pivot pins 62 in the respective bearing openings 63, thereby limiting the degree to which the clamping head 52 can pivot generally toward and generally away from the reciprocating blade 42. The ribs 65 and the keyed portions 63*a* facilitate assembly of the blade head assembly 14 by limiting the degree to which the clamping head 52 can pivot during assembly of the blade head assembly. It is believed that the ribs 65 and the keyed portions 63*a* do not have an effect on the performance of the blade head assembly 14 during operation of the appliance 10.

For purposes of facilitating assembly of the blade head assembly 14, the clamping device 50 may include other suitable means of limiting the degree to which the clamping head 52 pivots generally toward and generally away from the reciprocating blade 42 about the pivot axis A. For example, the clamping device 50 may include one or more rigid posts or stops (not shown) extending outward from the base 54. The posts may be configured to contact the arms 56 of the blade clamping device 50 when the arms are pivoted to a selected angular position about the pivot axis A. Such posts would inhibit the arms 56, and thus the clamping head 52, from pivoting beyond the posts in a direction generally away from the reciprocating blade 42. The clamping device 50 may include other suitable means of limiting the degree to which the clamping head 52 pivots generally toward and generally away from the reciprocating blade 42 about the pivot axis A during assembly of the blade head assembly 14. Furthermore, the ribs 65 and the keyed portions 63*a*, and/or other means for limiting the pivoting movement of the clamping head 52 may be suitably omitted without departing from the scope of the present invention.

As seen best in FIGS. 4-7, a spring member 66 (broadly, a resilient biasing member) resiliently biases the clamping head 52 toward the reciprocating blade 42 about the pivot axis A so that the guide rails 58 are slidably engaged in the groove 60 of the reciprocating blade 42, as described above. The illustrated spring member 66 is a helical torsion spring, and more specifically, a double torsion spring having a pair of coil portions 68 connected by an unwound tongue portion 69, and a pair of arm portions 70 extending outward from the respective coil portions. It is understood that the spring member 66 may have another suitable configuration without departing from the scope of the present invention. The coil portions 68 are received in a recess 72 of the base 54 (FIG. 6), and a hold down member 74, formed as part of the housing 12, retains the tongue portion 69 of the spring member 66 in a bending position in which the tongue portion is rotated toward the clamping head 52, generally parallel to the arm portions 70, to impart rotational forces on the respective arm portions. As seen in FIG. 2, the mounting plate 19 rests on top of the hold down member 74, and the screws 18 pass through openings in the hold down member and thread into threaded openings 19*a* in the mounting plate. As explained above, the screws 18 also pass through aligned openings 45, 57 in the stationary blade 40 and the base 54, respectively, thereby securing the blade head assembly 14 to the housing. Additional fasteners, such as screws (not shown), may secure the base 54 to the housing 12.

With the tongue portion 69 of the spring member 66 held in its bending position by the hold down member 74, the arm portions 70 of the spring member engage the clamping head 52 and transmit the force of the spring member to the clamping head. Terminal end margins of the arm portions 70 are received in respective slots 76 in the clamping head 52 to locate the arm portions in desired positions on the linear guide component adjacent to the ends of the clamping head. The spring member 66 exerts a load on the clamping head 52 of a magnitude sufficient to hold or retain the linear guide component (e.g., the rails 58) in operative, sliding engagement with the reciprocating blade 42 (e.g., in sliding engagement in the groove 60) so that the cutting edge margin of the reciprocating blade 42 is held or retained in face-to-face, sliding engagement with the cutting edge margin of the stationary blade 40 and the reciprocating shearing teeth 46 move across the stationary shearing teeth 44 in a substantially linear cutting path during operation. For example, the load exerted on the clamping head 52 by the spring member 66 in accordance with the illustrated embodiment may be of a magnitude from about 0.44 pound-force to about 0.66 pound-force. It is understood, however, that the spring member 66 may exert suitable load outside this range without departing from the scope of the present invention. It is also understood that the suitable magnitude of the force exerted by the spring 66 may be dependent on the type of hair cutting appliance.

As mentioned above, the arms 56 of the blade clamping device 50 are preferably relatively stiff to inhibit buckling of the arms when the hair cutting appliance 10 is under a relative large load (i.e., when cutting thick hair or cutting hair relatively quickly). More specifically, in one embodiment the arms 56 have bending stiffnesses sufficient to resist bending of the arms due to the load being applied to the clamping head 52 by the spring member 66. In other embodiments, though, the arms 56 may have bending stiffnesses that are insufficient to resist bending of the arms due to the load applied to the clamping head 52 by the spring member 66.

When introducing elements of the present invention or preferred embodiments thereof, the articles "a", "an", "the", and "said" are intended to mean that there are one or more of the elements. The terms "comprising", "including", and "having" are intended to be inclusive and mean that there may be additional elements other than the listed elements.

As various changes could be made in the above constructions and methods without departing from the scope of the invention, it is intended that all matter contained in the above description and shown in the accompanying drawings shall be interpreted as illustrative and not in a limiting sense.

What is claimed is:

1. A hand-held hair cutting appliance comprising:

a first blade including a plurality of shearing teeth defining a first cutting edge margin;

a second blade including a plurality of shearing teeth defining a second cutting edge margin, wherein the second cutting edge margin is in sliding engagement with the first cutting edge margin;

a drive assembly operatively connected to the second blade, the drive assembly being operable to impart reciprocating movement of the second blade relative to the first blade so that the shearing teeth of the second blade slide across the shearing teeth of the first blade; and a blade clamping device urging the second cutting edge margin in sliding engagement with the first cutting edge margin, the blade clamping device including a base, a clamping head, a resilient biasing member, and at least one bearing structure pivotably connecting the clamping head to the base such that the clamping head is configured for pivoting movement generally toward and generally away from the second blade about a pivot axis defined by the at least one bearing structure, wherein the biasing member resiliently biases said clamping head generally toward the second blade about said pivot axis into sliding engagement with the second blade, whereby the second blade is slidable relative to the clamping head during said reciprocating movement of the second blade relative to the first blade.

2. The appliance of claim 1 wherein the clamping head includes a linear guide component in said sliding engagement with the second blade, wherein the linear guide component is adapted to guide the second blade along a linear path during said reciprocating movement so that the shearing teeth of the second blade slide in a substantially linear cutting path across the shearing teeth of the first blade.

3. The appliance of claim 2 wherein the second blade has a groove, and wherein the linear guide component includes a rail received in the groove.

4. The appliance of claim 1 wherein the biasing member comprises a helical torsion spring.

5. The appliance of claim 1 further comprising a housing, wherein the first blade is stationary relative to the housing, the base being secured to the first blade.

6. The appliance of claim 1 wherein the clamping head further includes at least one arm pivotably coupled to the base via the at least one bearing structure to pivotably connect the clamping head to the base.

7. The appliance of claim 6 wherein the base includes a pair of spaced apart bearings each defining an opening, wherein said at least one arm is a pair of arms each having a pivot pin integrally formed thereon and received in one of the respective openings of the bearings to define the at least one bearing structure.

8. The appliance of claim 7 wherein the biasing member comprises a helical torsion spring, wherein the helical torsion spring has at least one coil portion secured to the base and at least one spring arm portion extending outward from said at least one coil portion, said at least one spring arm portion being operatively connected to the clamping head.

9. The appliance of claim 6 wherein the at least one arm has a bending stiffness sufficient to substantially resist bending of said at least one arm due to a load being applied to the clamping head by the biasing member.

10. The appliance of claim 1 wherein the pivot axis is substantially fixed relative to the first blade.

11. A hand-held hair cutting appliance comprising:

a first blade having a cutting edge margin;

a second blade having a cutting edge margin overlying at least a portion of the cutting edge margin of the first blade;

a drive assembly operatively connected to the second blade, the drive assembly being configured to impart reciprocating movement of the second blade relative to the first blade; and a blade clamping device holding the second blade in relation to the first blade, the blade clamping device including a base, a linear guide component engaging the second blade for guiding the second blade along a selected path during said reciprocating movement so that the cutting edge margin of the second blade moves in a substantially linear cutting path along the cutting edge margin of the first blade, at least one arm pivotably connecting the linear guide component to the base to allow for movement of the linear guide component generally toward and generally away from the second blade about a pivot axis, and a biasing member applying a load on the linear guide component in a direction generally toward the second blade, wherein the at least one arm has a bending stiffness sufficient to substantially resist bending of said at least one arm due to said load being applied to the linear guide component by the biasing member.

12. The appliance of claim 11 wherein the biasing member comprises a helical torsion spring.

13. The appliance of claim 12 wherein the helical torsion spring has at least one coil portion secured to the base and at least one arm portion extending outward from said at least one coil portion, said at least one arm portion being operatively connected to the linear guide component.

14. The appliance of claim 11 further comprising a housing, wherein the first blade is stationary relative to the housing, wherein the base is secured to the first blade.

15. The appliance of claim 11 wherein the base is formed integrally with the first blade.

16. The appliance of claim 11 wherein the base includes a pair of spaced apart bearings each defining an opening, wherein said at least one arm is a pair of arms each having a pivot pin integrally formed thereon and received in one of the respective openings of the bearings.

17. The appliance of claim 11 wherein the second blade has a groove, wherein the linear guide component includes a rail received in the groove.

18. The appliance of claim 11 wherein the cutting edge margin of the first blade and the cutting edge margin of the second blade each comprises a plurality of shearing teeth.

19. A blade head assembly for a hand-held hair cutting appliance of the type including an electric drive assembly, the blade head assembly comprising:

a first blade including a plurality of shearing teeth defining a cutting edge margin;

a second blade including a plurality of shearing teeth defining a cutting edge margin, wherein the cutting edge margin of the second blade is in sliding engagement with the cutting edge margin of the first blade and is configured for operative connection to the electric drive assembly of the hand-held hair cutting appliance to impart reciprocating movement of the second blade relative to the first blade; and a blade clamping device urging the cutting edge margin of the second blade in said sliding engagement with the cutting edge margin of the first blade, the blade clamping device including a base, a clamping head, a resilient biasing member, and at least one bearing structure pivotably connecting the clamping head to the base such that the clamping head is operable for pivoting generally toward and generally away from the second blade about a pivot axis defined by the at least one bearing structure, wherein the biasing member resiliently biases said clamping head generally toward the second blade about said pivot axis into sliding engagement with the second blade, whereby the second blade is slidable relative to the clamping head during said reciprocating movement of the second blade relative to the first blade.

* * * * *